US006019611A

United States Patent [19]

McHugh et al.

[11] Patent Number: 6,019,611

[45] Date of Patent: Feb. 1, 2000

[54] LAND GRID ARRAY ASSEMBLY AND RELATED CONTACT

[75] Inventors: Robert G. McHugh, Evergreen, Colo.; Nick Lin, Hsin -Chuang, Taiwan

[73] Assignee: Hon Hai Precision Ind. Co., Ltd., Taipei Hsien, Taiwan

[21] Appl. No.: 09/022,771

[22] Filed: Feb. 12, 1998

[51] Int. Cl.[7] ..... H01R 9/09

[52] U.S. Cl. ..... 439/71; 439/515; 439/66

[58] Field of Search ..... 439/70, 71, 74, 439/66, 862, 515

[56] References Cited

U.S. PATENT DOCUMENTS

| | | | |
|---|---|---|---|
| 4,341,433 | 7/1982 | Cherian et al. | 439/71 |
| 4,354,729 | 10/1982 | Grabbe et al. | 439/71 |
| 4,906,194 | 3/1990 | Grabbe | 439/71 |
| 5,154,620 | 10/1992 | Martucci et al. | 439/330 |
| 5,713,744 | 2/1998 | Laub | 439/71 |

*Primary Examiner*—Steven L. Stephan

*Assistant Examiner*—T C Patel

[57] ABSTRACT

An LGA type IC assembly is mounted on a PCB by means of a fastening means which sandwiches the LGA assembly and the PCB between two plates. Conductive contacts received in passageways defined through a socket of the assembly each have two engagement portions projecting beyond the outer surfaces of the socket to contact corresponding flat contact pads formed on an IC package and the PCB, a beveled edge on an upper portion of a main body thereof, and a C-shaped resilient beam extending from the main body and forming a slanted portion integrally formed with the upper engagement portion. The IC package delivers a normal force to each contact causing the upper engagement portion thereof to slide across a surface of a corresponding contact pad of the IC package thereby removing oxidation therefrom, while the slanted portion contacts the beveled edge thereby shortening the signal transmission path through each contact. A retaining means formed on the contact secures the contact within the passageway and allows for slight vertical movement thereof, thereby preventing signal loss due to warpage of the PCB.

13 Claims, 4 Drawing Sheets

LAND GRID ARRAY ASSEMBLY AND RELATED CONTACT

BACKGROUND OF THE INVENTION

1. Field of the Invention

The present invention relates to an electrical connector, and more particularly to a high density land grid array connector for connecting an integrated circuit package to a printed circuit board, having space efficient contacts which facilitate the signal transmission between the connected components.

2. The Prior Art

The use of high density integrated circuit (IC) packages of the LSI/VLSI categories is becoming increasingly more common as the trend of the computer market continues toward compactness requiring the miniaturization of IC packages. Input/output pins of such IC packages to be mounted on a printed circuit board (PCB) are arranged in such a dense pattern (sometimes as many as two hundred closely spaced contact elements) that direct soldering of the IC package to the PCB creates several significant problems in inspecting and correcting any resulting soldering faults thereof. Therefore, a socket having a plurality of conductive contacts is commonly employed for engaging the pins of the IC package and providing an electrical path to the PCB.

A pin grid array (PGA) type IC has a number of lead pins projecting downwardly from a lower surface of the main body thereof. The pins are matingly received in corresponding contacts of a related PGA socket which are engaged with holes defined in predetermined locations on the PCB for connecting with electrical circuitry thereof. PGAs along with their associated sockets and contact elements are disclosed in U.S. Pat. Nos. 4,381,130, 4,498,725, 4,648,669, 4,674,811, and 5,057,031.

One shortcoming of the PGA type IC is the tendency of the pins thereof to become easily damaged. Therefore, a ball grid array (BGA) type IC has been introduced which has essentially the same structure as the PGA except that ball-shaped contacts replace the conventional straight pins of the PGA thereby effectively overcoming the pin damage drawback. Such BGAs have previously been disclosed in U.S. Pat. Nos. 5,518,410, 5,547,389, and 5,641,297.

Unfortunately, the small engagement surface area of the ball-shaped contacts do not provide an adequate electrical connection with the contacts of the corresponding socket. In addition, both PGAs and BGAs are ineffective in applications requiring a denser-than-usual contact element arrangement, such as for a central processing unit (CPU) used in portable computers. Such high density contact elements would result in closely positioned holes in the PCB for engagement therewith which becomes laborious due to spatial constrictions.

To overcome the limitations of the PGAs and BGAs in the case of very dense contact elements, a land grid array (LGA) type IC has been introduced. The distinctive characteristics of the LGA socket are embodied in the resilient contact elements which each expose portions thereof to both the upper and lower surfaces of the socket for engaging with flat contact pads located on a bottom surface of the main body of the IC package and on a top surface of the PCB, respectively. The contact elements of the LGA socket are formed having two free ends which are spaced apart a predetermined distance in the unassembled state. When the IC package is assembled with the LGA socket and mounted on the PCB, a normal force causes the two free ends of each contact to contact each other thereby shortening the signal transmission path therethrough. If the free ends do not contact each other due to an insufficient normal force, the signal will still be transmitted through the contact but along a longer path. U.S. Pat. Nos. 4,684,184, 5,199,889, and 5,232,372 disclose prior art LGAs.

The contact elements associated with the prior art LGAs exhibit different shapes but the basic component of each lies in the two free ends being connected by a curved portion which provides the contact with resiliency so that the two free ends will touch when the IC package is assembled with the socket and mounted on the PCB. Due to the extended length of the curved portion, the LGA socket must have a substantial thickness to enclose the contacts in passageways therein which increases the space occupied by the LGA assembly. Furthermore, the prior art LGAs do not address factors which may result in signal loss such as PCB warpage or oxidation formed on the contact pads of the IC package. Therefore, an improved contact for use in an LGA socket is required which can overcome the drawbacks of conventional LGA socket contacts.

SUMMARY OF THE INVENTION

An objective of the present invention is to provide a space efficient contact for an IC package socket having a C-shaped resilient beam which will deform when exposed to a sufficient normal force from a related IC package.

Another objective of the present invention is to reduce the signal transmission path through the contacts of the socket thereby lowering the incidence of signal loss and improving frequency performance characteristics of the IC package assembly.

A further objective of the present invention is to allow slight vertical movement of the contact within the passageway of the socket thereby allowing the contact to compensate for PCB warpage when the socket is mounted on the PCB.

Yet another objective of the present invention is to provide each contact of the socket with anti-oxidation means whereby an engagement portion of the contact which engages with the contact pad of the IC package will slide across and slightly scrape the pad each time the IC package is assembled with the socket thereby removing oxidation formed on the pad and improving the transmission path therebetween.

In accordance with one aspect of the present invention, an LGA type IC assembly includes an IC package having a plurality of flat contact pads formed on a bottom surface thereof, a socket having an insulative housing and defining a plurality of passageways therethrough, and a plurality of conductive contacts received in the passageways of the housing. Positioning means correctly aligns the IC package with the socket then the LGA assembly is mounted on a PCB by means of a fastening means which sandwiches the LGA assembly and the PCB between two plates.

Each conductive contact includes a main body having a beveled edge on an upper portion thereof. A curved extension and an extension arm each extend from opposite lower portions of the main body, and a lower engagement portion downwardly extends from the main body between the curved extension and the extension arm. A C-shaped resilient beam integrally formed with the curved extension forms a slanted portion and an upper engagement portion at an opposite end thereof wherein the slanted portion faces the beveled edge. An elongate retaining arm upwardly projects from the extension arm of the main body. A lower retaining projection outwardly extends from a lower portion of the retaining arm and an upper retaining projection outwardly extends from an upper portion of the retaining arm.

When the contact is received in a corresponding passageway of the socket, a protrusion formed on an inner surface of each passageway is received in a space defined between the two retaining projections to secure the contact therein. The protrusions of the passageways are slightly smaller than the space between the two retaining projections which enables the contacts to move vertically within the passageway thereby preventing signal loss due to warpage of the PCB. The engagement portions of the contact project beyond the outer surfaces of the socket to engage the corresponding contact pads of the IC package and the PCB. When the contact receives a normal force from the IC package, the upper engagement portion scrapes the surface of the corresponding contact pad of the IC package thereby effectively removing any oxidation build-up thereon, and the resilient beam deforms so that the slanted portion contacts and slides along the beveled edge thereby shortening the signal transmission path therethrough.

DETAILED DESCRIPTION OF THE PREFERRED EMBODIMENT

Figure 1:
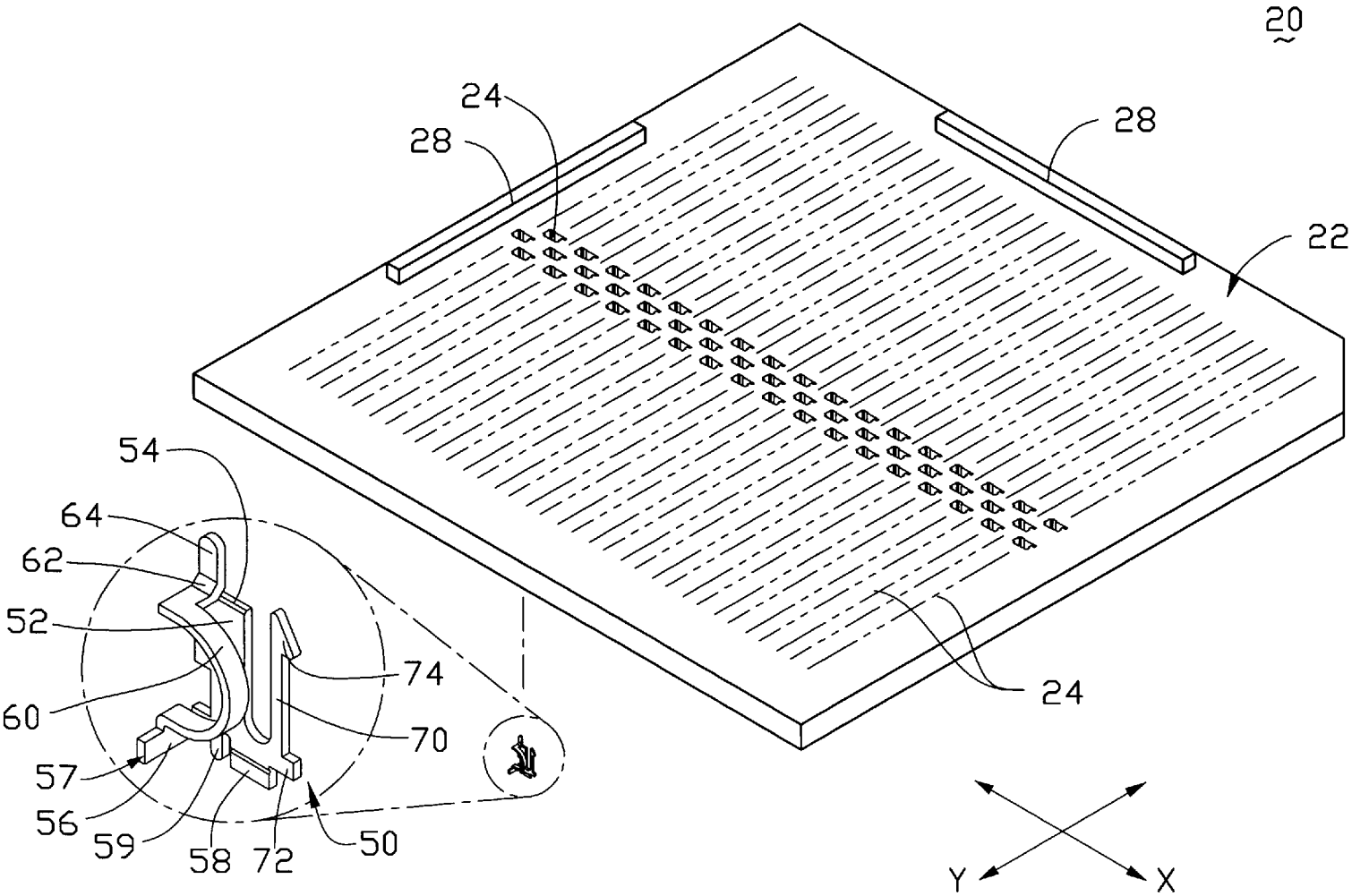
FIG. 1 is a perspective view of an electrical connector in accordance with the present invention showing an enlarged view of a conductive contact for use therein.
Figure 2A:
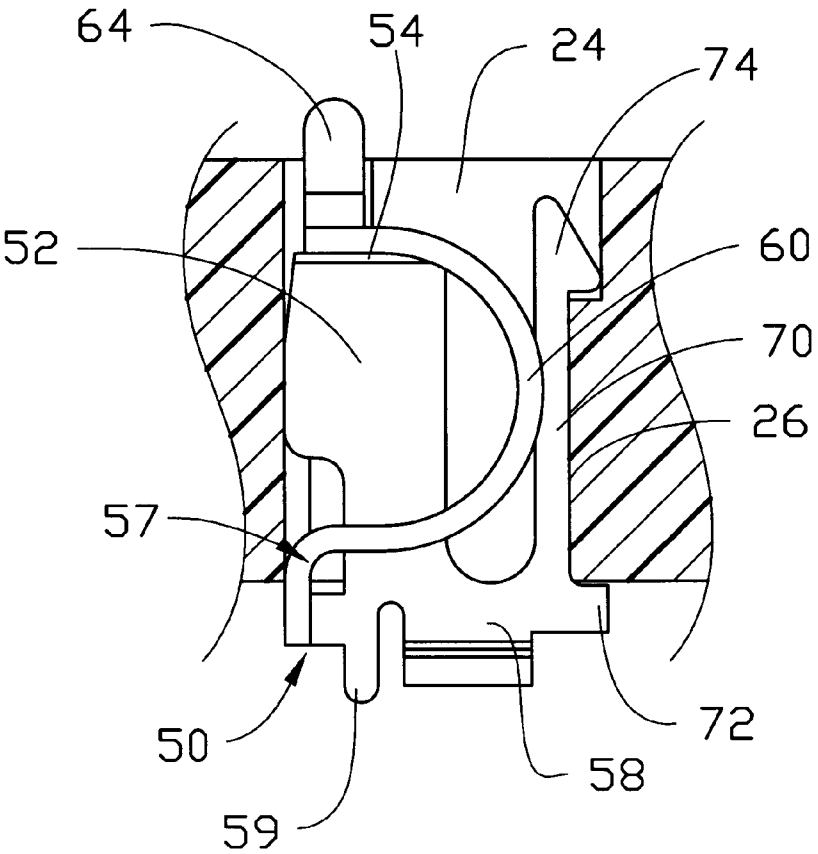
FIG. 2A is a front cross-sectional view of the contact received in a passageway of the connector in accordance with the present invention.
Figure 3:
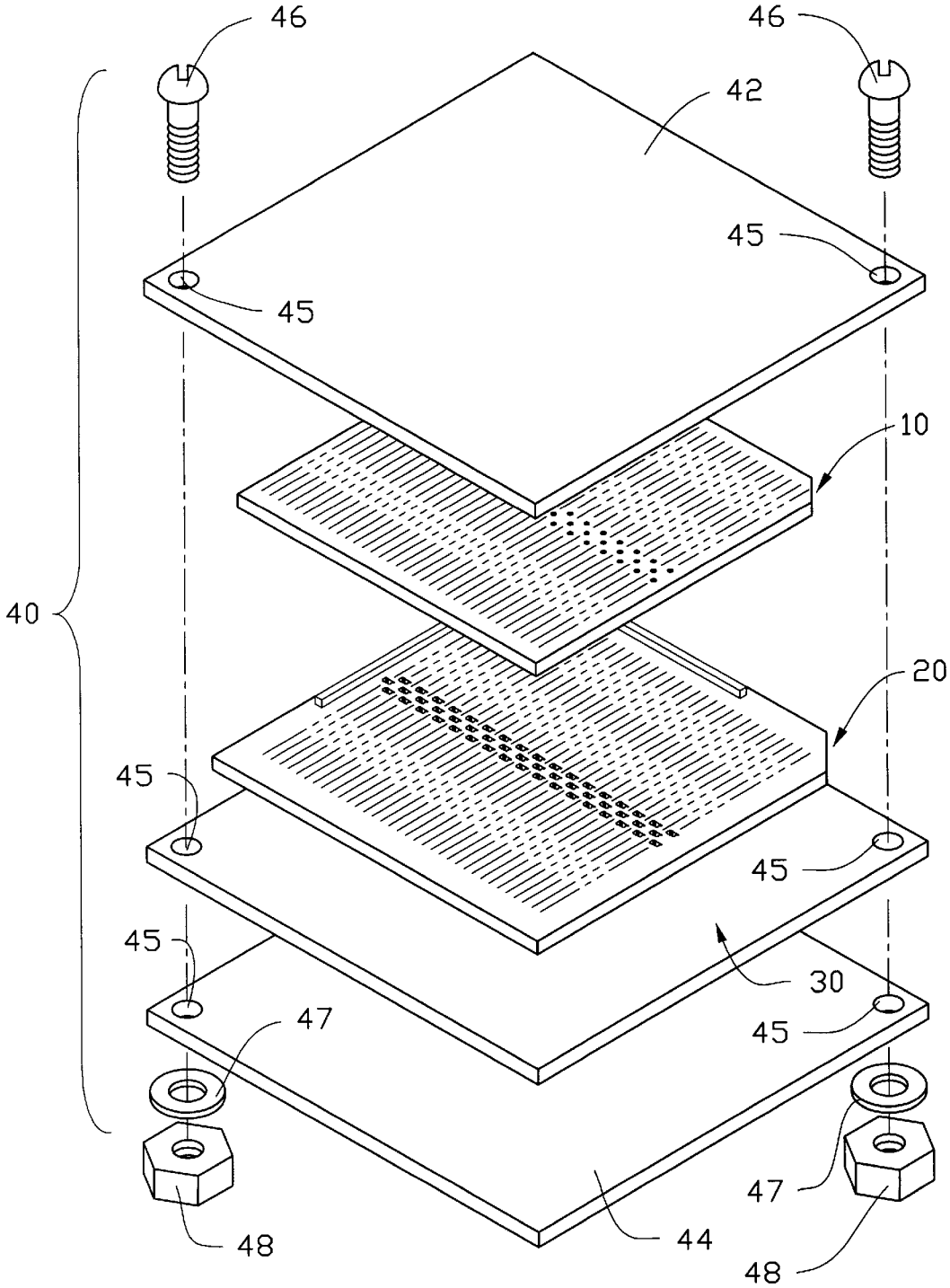
FIG. 3 is an exploded view of an electrical assembly of the present invention showing a printed circuit board and fastening means.

Referring to FIGS. 1 and 3, an LGA assembly in accordance with the present invention includes an IC package 10 having a plurality of flat contact pads 15 (best seen in FIG. 4) formed on a bottom surface thereof, a socket 20 having an insulative housing 22 and defining a plurality of passageways 24 therethrough, and a plurality of conductive contacts 50 received in the passageways 24 of the socket 20. The socket 20 forms two elongate positioning ribs 28 on adjacent sides of an upper surface thereof for properly aligning the IC package 10 therewith. Each passageway 24 has a protrusion 26 (shown in FIG. 2A) formed on an inner wall thereof and projecting into the passageway 24.

The LGA assembly is mounted on a PCB 30 by means of a fastening means 40 consisting of a top plate 42 positioned on a top surface of the IC package 10, a bottom plate 44 positioned on a bottom surface of the PCB 30, and a plurality of sets of aligned holes 45 defined through the PCB 30 and the plates 42, 44, wherein each set of aligned holes 45 receives a screw 46 therein which engages with a washer 47 and a nut 48 thereby sandwiching the LGA assembly between the two plates 42, 44.

Figure 2B:
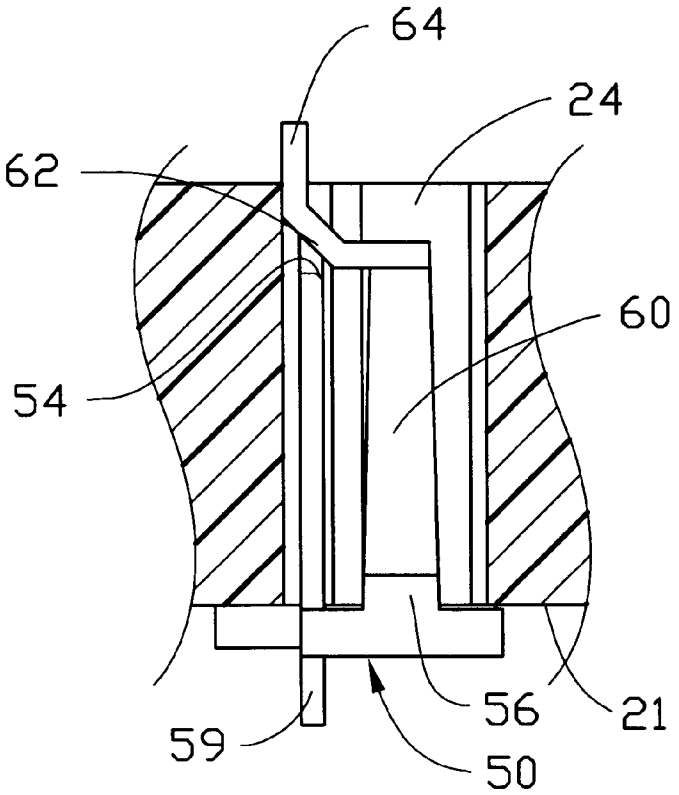
FIG. 2B is a side cross-sectional view of the contact received in a passageway of the connector in accordance with the present invention.

Referring to FIGS. 2A and 2B, each conductive contact 50 includes a main body 52 having a beveled edge 54 on an upper portion thereof. A curved extension 56 and an extension arm 58 each extend from opposite lower portions of the main body 52 wherein the base 57 of the curved extension 56 generally extends in a plane perpendicular to the plane of main body 52 while the extension arm 58 extends in a coplanarity relationship with the main body 52, and a lower engagement portion 59 downwardly extends from the main body 52 of the contact 50 between the curved extension 56 and the extension arm 58. A C-shaped resilient beam 60 integrally formed with the curved extension 56 forms a plate-like slanted portion 62 and an upper engagement portion 64 at an opposite end thereof, wherein the slanted portion 62 faces the beveled edge 54. An elongate retaining arm 70 upwardly projects from the extension arm 58. A lower retaining projection 72 outwardly extends from a lower portion of the retaining arm 70 and an upper retaining projection 74 outwardly extends from an upper portion of the retaining arm 70.

When the contact 50 is received in a corresponding passageway 24 of the socket 20, the protrusion 26 of the passageway 24 is received in a space defined between the retaining projections 72, 74 to secure the contact 50 within the passageway 24. The length of the protrusion 26 of the passageway 24 is slightly smaller than the distance between the two retaining projections 72, 74 which enables the contact 50 to move vertically within the passageway 24 in a floating manner thereby preventing signal loss due to warpage of the PCB 30. The engagement portions 59, 64 project beyond the outer surfaces of the socket 20 to contact the corresponding contact pads 15 (shown in FIG. 4) of the PCB 30 and the IC package 10, respectively.

Figure 4:
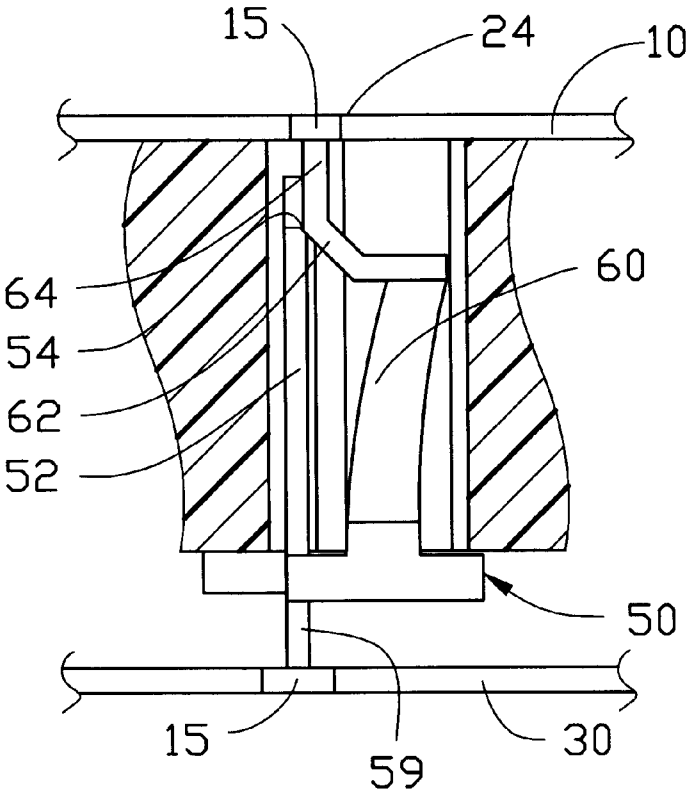
FIG. 4 is a side cross-sectional view of the contact received in the passageway of the electrical assembly in accordance with the present invention.

Referring to FIG. 4, when the whole assembly is assembled, the upper engagement portion 64 receives a normal force from the IC package 10 and the resilient beam 60 deforms so that the slanted portion 62 contacts and slides along the beveled edge 54 thereby shortening the signal transmission path therethrough, and the upper engagement portion 64 scrapes a surface of the contact pad 15 of the IC package 10 thereby effectively removing any oxidation build-up thereon. The normal force from the IC package 10 causes a reactive force from the resilient beam 60 to be directed coplanar to the socket 20 toward the two positioning ribs 28 (shown in FIG. 1) thereof, thereby urging outer edges of the IC package 10 to abut against the ribs 28 to maintain alignment of the IC package 10 with the socket 20. In a detailed analysis, other than the vertical deflection of the resilient beam 60 mainly due to the vertical depression of the C-shaped resilient beam 60, the deflection of the resilient beam 60 also includes a deformation in a horizontal plane. Such deformation due to mechanical confrontation of the slanted portion 62 of the resilient beam 60 downwardly sliding along the beveled edge 54 of the main body 52, should include a main component along Axis Y away from the main body 52, and a secondary component along Axis X away from the base 57 of the extension 56. The bending moments generated in these two relatively perpendicular directions, result in a combined reactive force generally directing to the intersection corner of the ribs 28. This is a feature of the invention that the IC package 10 is urged to abut against the ribs 28 for proper alignment and retention with regard to the socket.

Moreover, due to the "C" shape of the resilient beam 60, the contacts 50 of the present invention occupy a smaller space than related contacts of the prior art. The contacts 50 of the present invention also improve the performance of the LGA assembly by ensuring a proper signal transmission path between the IC package 10 and the PCB 30. Therefore, the present invention should be granted a patent.

It is also noted that during a non-engagement status, the resilient beam 60 does not contact the main body 52, i.e., the slanted portion 62 of the resilient beam 60 is spaced from the corresponding beveled edge 54 of the main body 52. It forms no mechanical deflection of resilient beam 60 and no shorter signal transmission path between the upper engagement portion 64 of the beam 60 and the main body 52. Oppositely, during an engagement status, the resilient beam 60 substantially contacts the main body 52 through its slanted portion 62 against the beveled edge 54 of the main body 52, thus resulting in not only a shorter signal transmission path between the upper engagement portion 64 and the main body 52 to the lower engagement portion 59 from an electrical viewpoint, but also a three dimensional deflection of the resilient beam 60 from a mechanical viewpoint.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. An electrical connector for electrically engaging an integrated circuit (IC) package with a printed circuit board (PCB), including an insulative housing with at least one passageway defined therethrough and a conductive contact received in each at least one passageway, said each passageway having a protrusion formed on an inner wall thereof projecting into the passageway;

said housing forming a positioning means on a top surface thereof to maintain alignment with the IC package;

each contact including a main body having a beveled edge on an upper portion thereof, a curved extension and an extension arm extending from opposite lower portions of the main body, a lower engagement portion downwardly extending from the main body between the curved extension and the extension arm, a resilient beam integrally formed with the curved extension forming a slanted portion and an upper engagement portion at an opposite end thereof, and retaining means for securing each contact within the corresponding passageway;

whereby when the contact is received in the corresponding passageway of the housing, the retaining means thereof engages with the protrusion of the passageway, and when the IC package is engaged with the connector a normal force is exerted on the upper engagement portion of each contact causing the slanted portion of the resilient beam to contact the beveled edge thereby shortening the signal transmission path through each contact, and the normal force from the IC package causes a reactive force from the resilient beam to be directed coplanar to the connector toward the positioning means thereby urging outer edges of the IC package to abut against the positioning means.

2. The connector as described in claim 1, wherein the upper and lower engagement portions respectively project beyond upper and lower surfaces of the connector for contacting corresponding flat contact pads formed on the IC package and PCB.

3. The connector as described in claim 1, wherein the positioning means consists of two elongate ribs formed on adjacent sides of an upper surface of the connector.

4. The connector as described in claim 1, wherein the retaining means consists of an elongate retaining arm upwardly projecting from the extension arm, a lower retaining projection outwardly extending from a lower portion of the retaining arm, and an upper retaining projection outwardly extending from an upper portion of the retaining arm.

5. The connector as described in claim 4, wherein the length of the protrusion of the housing is slightly smaller than the distance between the two retaining projections thereby enabling the contact to move vertically within the passageway for preventing signal loss due to PCB warpage.

6. A conductive contact received in an electrical connector for electrically connecting at least one flat contact pad formed on a bottom surface of an integrated circuit (IC) package to a corresponding flat contact pad formed on a top surface of a printed circuit board (PCB) wherein said connector defines at least one passageway therethrough for receiving the at least one contact and has a protrusion formed on an inner wall of each passageway and projecting into;

each contact including a main body having a beveled edge on an upper portion thereof, a curved extension and an extension arm extending from opposite lower portions of the main body, a lower engagement portion downwardly extending from the main body between the curved extension and the extension arm, a resilient beam integrally formed with the curved extension forming a slanted portion and an upper engagement portion at an opposite end thereof, and retaining means for securing each contact within the corresponding passageway;

whereby when the contact is received in the corresponding passageway of the housing, the retaining means thereof engages with the protrusion of the passageway, and when the IC package is engaged with the connector a normal force is exerted on the upper engagement portion of each contact causing the slanted portion of the resilient beam to contact the beveled edge thereby shortening the signal transmission path through each contact.

7. An electrical assembly including an IC package secured to a PCB by means of an electrical connector and fastening means;

said connector including an insulative housing with at least one passageway defined therethrough and a conductive contact received in each passageway, each passageway having a protrusion formed on an inner wall thereof projecting into the passageway;

said housing forming a positioning means on a top surface thereof to maintain alignment with the IC package;

said fastening means consisting of a top plate positioned on a top surface of the IC package, a bottom plate positioned on a bottom surface of the PCB, and fixing means for securely sandwiching the IC package, the connector, and the PCB between the two plates;

each contact including a main body having a beveled edge on an upper portion thereof, a curved extension and an extension arm extending from opposite lower portions of the main body, a lower engagement portion downwardly extending from the main body between the curved extension and the extension arm, a resilient beam integrally formed with the curved extension forming a slanted portion and an upper engagement portion at an opposite end thereof, and retaining means for securing each contact within the corresponding passageway;

whereby when the contact is received in the corresponding passageway of the housing, the retaining means thereof engages with the protrusion of the passageway, and when the IC package is engaged with the connector a normal force is exerted on the upper engagement portion of each contact causing the slanted portion of the resilient beam to contact the beveled edge thereby shortening the signal transmission path through each contact, and the normal force from the IC package causes a reactive force from the resilient beam to be directed coplanar to the connector toward the positioning means thereby urging outer edges of the IC package to abut against the positioning means.

8. The assembly as described in claim 7, wherein the fixing means consists of at least one aligned hole defined in each of the plates and the PCB, having a screw extending therethrough for engagement with a washer and a nut.

9. An arrangement of a connector mounted on a board for interconnecting with an electrical component having a plurality of circuit pads on a bottom surface thereof, said connector comprising:

an insulative housing defining a plurality of passageways extending therethrough;

a plurality of contacts received within said passageways, respectively, each of said contacts including a main body extending in a first horizontal direction, and an extension having a base integrally extending from said main body in a second horizontal direction which is perpendicular to said first horizontal direction; and a resilient beam extending upward from said base with engagement means at a top portion thereof for engagement with the corresponding pad of the electrical component;

wherein when the engagement means of the resilient beam engages with the corresponding pad of the electrical component and the resilient beam is deflected in the first, the second and a third directions, the third direction being perpendicular to both the first and the second directions by means of engagement between the resilient beam and the main body.

10. The arrangement as defined in claim 9, wherein means is provided for slidable abutment of the resilient beam against the main body in both the third direction and the second direction.

11. The arrangement as defined in claim 10, wherein said means is a planar, slanted portion formed adjacent to an upper portion of the resilient beam which is adapted to slidably abut against a top end of the main body for bringing about a first movement thereof in the third direction and a second movement thereof in the second direction relative to the main body.

12. A combination of an electrical assembly including a first plate and a second plate sandwiching an electrical component, a corresponding connector and a PC board therebetween, said connector including an insulative housing defining a plurality of passageways extending therethrough, a plurality of contacts received within the corresponding passageways, respectively, each of said contacts including an upper engagement portion and a lower engagement portion for engagement with corresponding pads on the electrical component of the board, respectively, each of said contacts further including a resilient beam adapted to be deflected in a first horizontal direction and a second horizontal direction perpendicular to said first direction when the upper engagement portion and the lower engagement portion of the contact are both properly engaged with the electrical component and the PC board, said connector further including aligning means for orienting the connector with respect to the electrical component by a combined reactive force due to a defection of said resilient beam in both the first and second directions.

13. The combination as defined in claim 12, wherein said aligning means includes ribs extending along both the first and the second directions.

* * * * *